US006749462B2

(12) United States Patent
Sun et al.

(10) Patent No.: US 6,749,462 B2
(45) Date of Patent: Jun. 15, 2004

(54) DISPLAY UNIT

(75) Inventors: Ming-Shen Martin Sun, Hsinchu (TW); Guang Tau Sung, Taichung Hsien (TW); Kuo-Chung Lee, Yunlin Hsien (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 10/390,348

(22) Filed: Mar. 17, 2003

(65) Prior Publication Data

US 2003/0181102 A1 Sep. 25, 2003

Related U.S. Application Data

(63) Continuation-in-part of application No. 09/950,166, filed on Sep. 10, 2001, now abandoned.

(30) Foreign Application Priority Data

Dec. 19, 2000 (TW) ..... 89127254 A

(51) Int. Cl.[7] ..... H01R 13/58

(52) U.S. Cl. ..... 439/604; 439/275; 439/587

(58) Field of Search ..... 439/604, 606, 439/556, 559, 587, 275

(56) References Cited

U.S. PATENT DOCUMENTS

| | | | | | |
|---|---|---|---|---|---|
| 2,460,636 | A | * | 2/1949 | Holloway | 439/559 |
| 2,633,483 | A | * | 3/1953 | Hafke | 439/556 |
| 2,968,783 | A | * | 1/1961 | Puetz | 439/556 |
| 5,993,256 | A | * | 11/1999 | Shimojyo | 439/604 |
| 6,190,212 | B1 | * | 2/2001 | Brown et al. | 439/736 |

* cited by examiner

*Primary Examiner*—Gary Paumen
*Assistant Examiner*—James R. Harvey
(74) *Attorney, Agent, or Firm*—Darby & Darby

(57) ABSTRACT

A display unit comprises a case, a panel, a lamp, an intermediate and a lead wire. The lamp is placed next to the panel, and the lead wire is electrically connected to the lamp to form a conjunctive portion. The conjunctive portion is placed in a mold and integrally covered with the intermediate. When the lead wire is pulled by an abnormal or abrupt force, the majority of the force can be absorbed by the intermediate pressed on the case, and the lead wire can remain fixed to the lamp.

13 Claims, 5 Drawing Sheets

DISPLAY UNIT

CROSS REFERENCE TO RELATED APPLICATION

This is a continuation-in-part application of U.S. patent application Ser. No. 09/950,166 filed Sep. 10, 2001, now abandoned.

BACKGROUND OF THE INVENTION

1. Field of the Invention

This invention relates to a display unit. More particularly, this invention relates to a display unit provided with a lamp and a lead wire, which are connected and molded with an intermediate thereon.

2. Description of Prior Art

Referring to FIGS. 1A and 1B, FIG. 1A is a view showing a display structure 1 according to the prior art, and FIG. 1B is a top view of FIG. 1A.

In FIG. 1A, a display unit 1 comprises a case 10, a panel 11, a lamp 12 having two ports 121(121), two plastic sleeves 13(13) and two lead wires 14(14), wherein the lead wires 14(14) are respectively applied with high voltage and grounded. The panel 21 and the lamp 12 are received in the case 10, and the lamp 12 is placed next to the panel 21. The lamp 12 has two ports 121(121), and the lead wires 14(14) are connected to the ports 121(121).

In FIG. 1B, the plastic sleeve 13 covers the junction of the port 121 of the lamp 12 and the lead wires 14 which are connected, and the plastic sleeve 13 is used as a stopper placed against the case 20.

Referring to FIGS. 2A and 2B, FIG. 2A is an enlarged view according to a region Z1 of FIG. 1B, and FIG. 2B is an exploded view according to FIG. 2A.

In FIG. 2B, the port 121 is extended from the lamp 12, and a hole 122 is formed on the end of the port 121. Another port 141 is formed on the end of the lead wire 14. The sleeve 13 is a hollow element provided with an L-shaped through hole 130 therein. The lead wire 14 is connected to the lamp 12 by plugging the port 141 to the hole 122 of the port 121 within the L-shaped through hole 130 of the sleeve 13. As the sleeve 13 is set on the port 121 of the lamp 12 and the port 141 of the wire 14, the sleeve 13 can be used as a stopper with its end 131 adjacent to the case 10.

FIG. 2C is a cross-sectional view according to FIG. 2A. Clearances exist between the sidewall of the L-shaped through hole 130 and the port 121 as well as between the sidewall of the L-shaped through hole 130 and the port 141. Once the lead wire 14 is pulled by an abnormal or abrupt force F, the force F is directly transmitted to the port 121 of the lamp 12, and the lead wire 14 is easily dislodged from the lamp 12 even if the sleeve 13 is pressed on the case 10.

SUMMARY OF THE INVENTION

To solve the above problem, the primary object of this invention is to provide a method for forming a display unit. The display unit comprises a panel, a lamp having a first port and a lead wire having a second port connected to the first port to form a conjunctive portion. A mold is provided with a cavity and a riser. The conjunctive portion is placed in the cavity and a fluxed intermediate is injected into the cavity to integrally coat on the conjunctive portion.

BRIEF DESCRIPTION OF THE DRAWINGS

The present invention can be more fully understood by reading the subsequent detailed description and examples with reference made to accompanying drawings in which.

DETAILED DESCRIPTION OF THE PREFERRED EMBODIMENTS

Figure 1A:
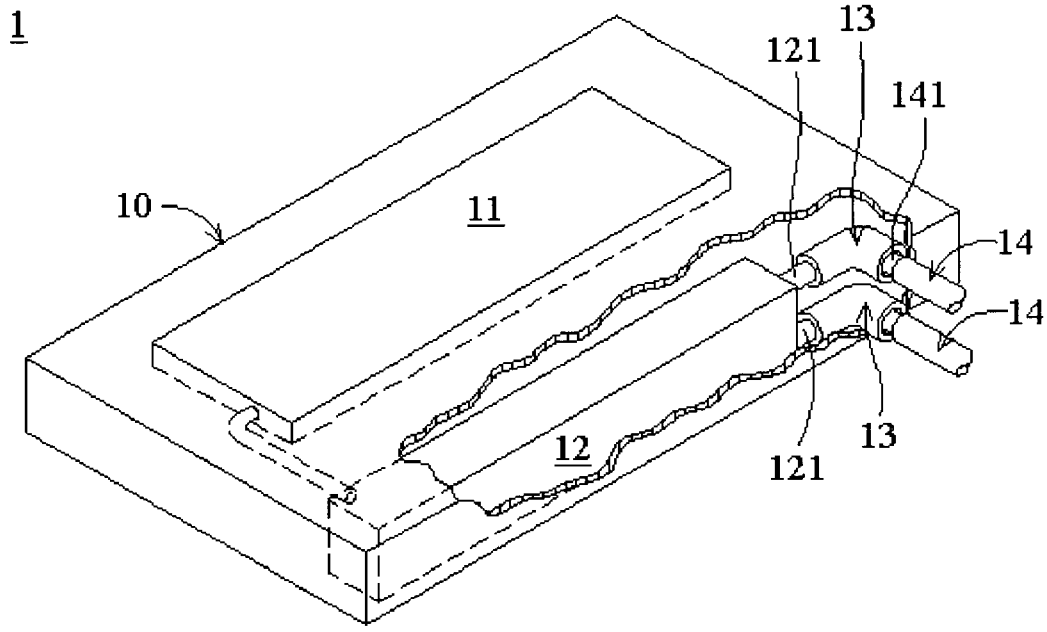
FIG. 1A ( PRIOR ART )
FIG. 1A is a view showing a display structure (1) according to the prior art.
Figure 1B:
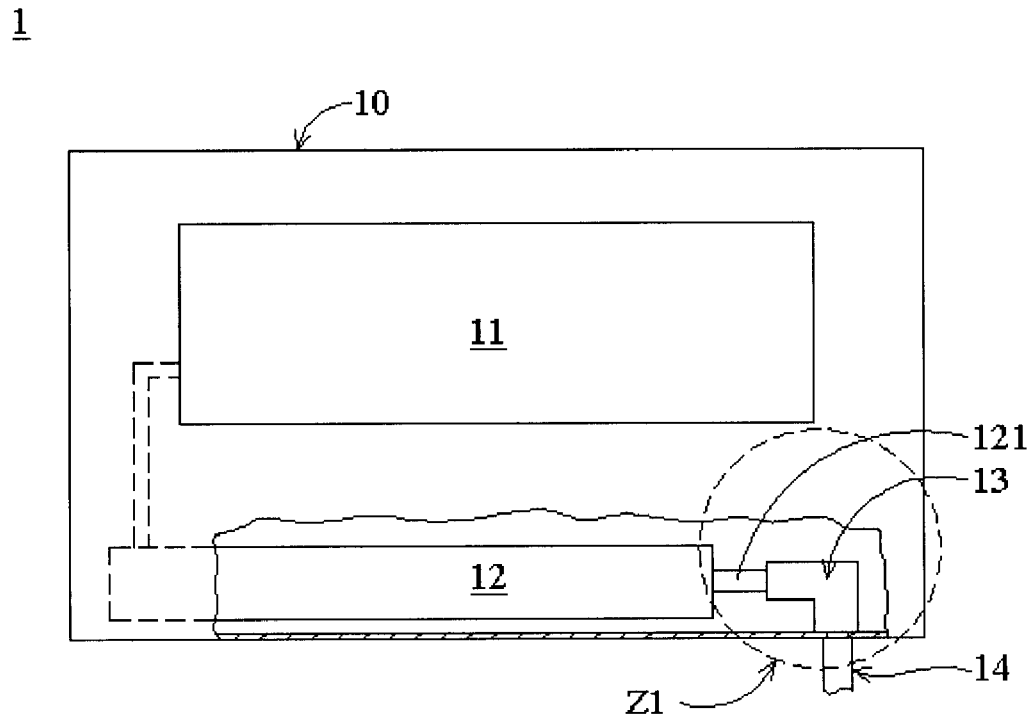
FIG. 1B ( PRIOR ART )
FIG. 1B is a top view of FIG. 1A.
Figure 2A:
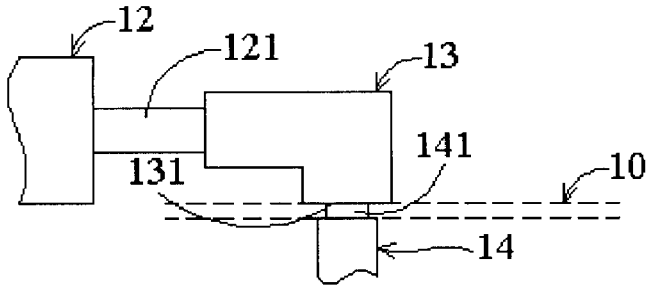
FIG. 2A ( PRIOR ART )
FIG. 2A is an enlarged view according to a region (Z1) of FIG. 1B.
Figure 2B:
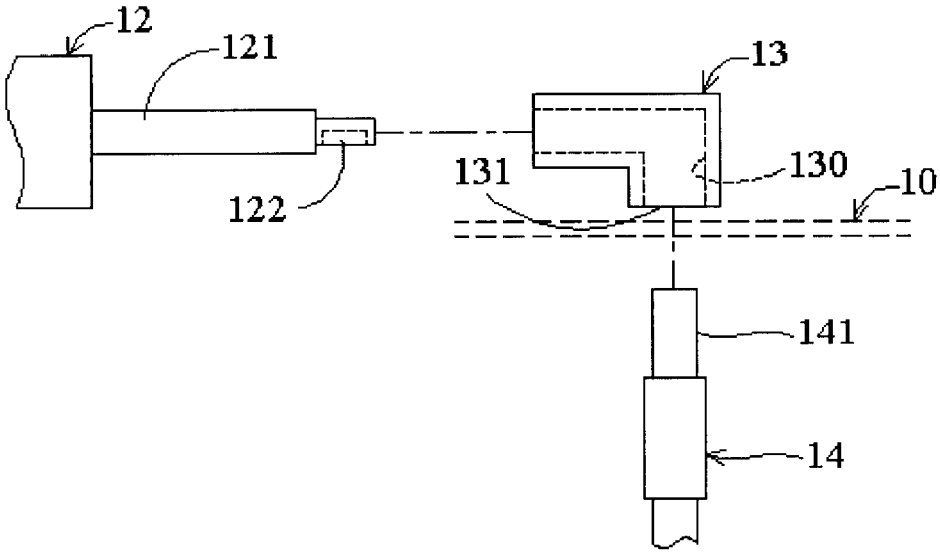
FIG. 2B ( PRIOR ART )
FIG. 2B is an exploded view according to FIG. 2A.
Figure 2C:
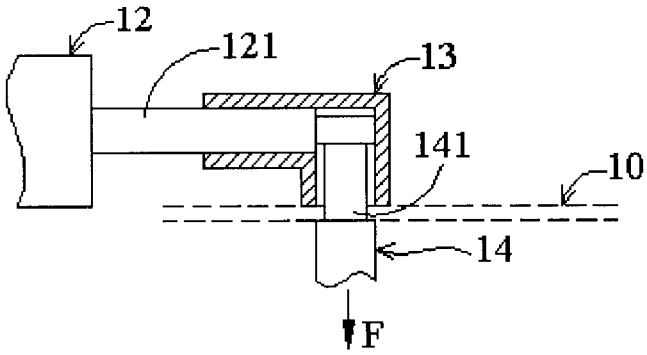
FIG. 2C ( PRIOR ART )
FIG. 2C is a cross-sectional view according to FIG. 2A.
Figure 3A:
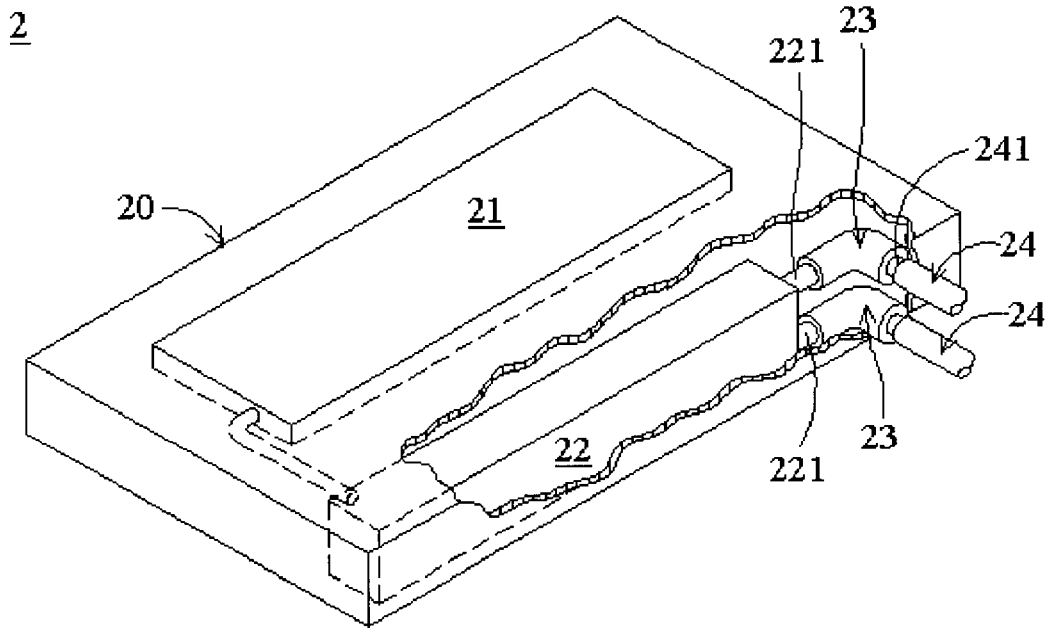
FIG. 3A is a view showing a display unit (2) according to a first embodiment of the present invention.
Figure 3B:
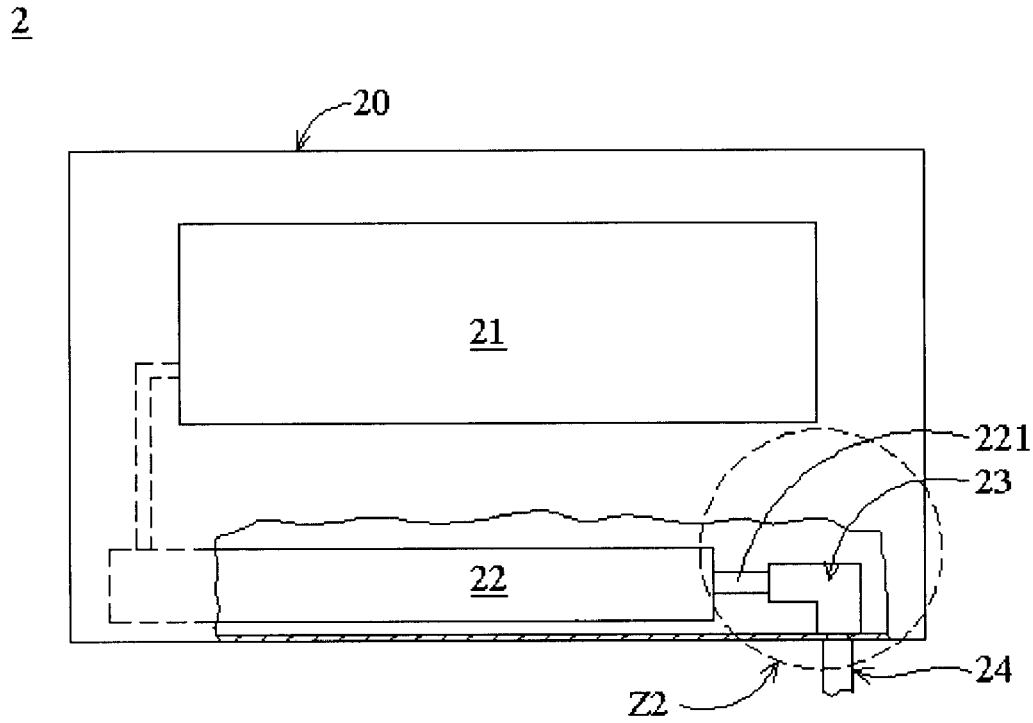
FIG. 3B is a top view of FIG. 3B.

Referring to FIGS. 3A and 3B, a display unit 2 according to the first embodiment comprises a case 20, a panel 21, a lamp 22 having two first ports 221(221), one intermediate 23 and two lead wires 24(24). The lamp 22 is placed next to the panel 21, and the lead wires 24 are electrically connected to the first ports 221(221) of the lamp 22. One of the lead wires 24(24) is applied with high voltage, and the other is grounded.

The intermediate 23, preferably made of polymer such as rubber, thermoplastic material, thermosetting material, UV glue or Epoxy glue, is integrally formed on a conjunctive portion, which is a portion located at the intersection of the first port 221 of the lamp 22 and the lead wire 24. The first port 221 of the lamp 22 and the lead wire 24 are fixed together by the intermediate 23.

Figure 5A:
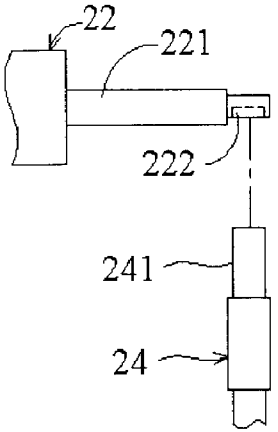
FIG. 5A is an exploded view according to FIG. 4.
Figure 4:
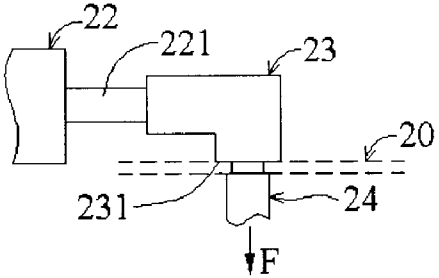
FIG. 4 is an enlarged view according to a region (Z2) of FIG. 3B.

In FIG. 4, an enlarged view shows a region Z2 of FIG. 3B, and FIG. 5A is an exploded view according to FIG. 4 without the intermediate 23.

In FIG. 5A, the first port 221 extends from the main body of the lamp 22, and a hole 222 is formed on the free end of the first port 221. A second port 241 is formed on the end of the lead wire 24. The lead wire 24 is temporally connected to the lamp 22 by plugging the second port 241 to the hole 222 of the first port 221.

Figure 5C:
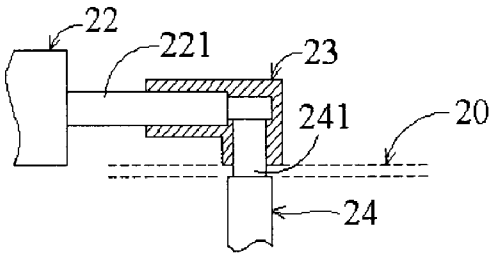
FIG. 5C is a cross-sectional view according to FIG. 4.
Figure 5B:
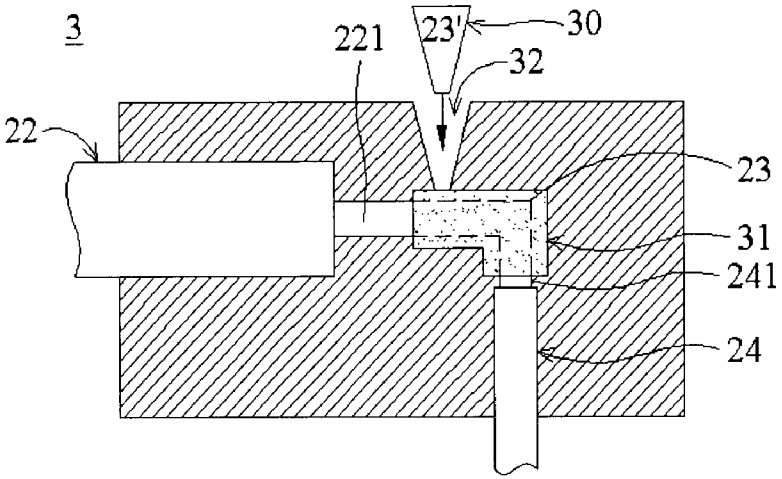
FIG. 5B is a cross-sectional view showing the inner structure of a mold (3) which is provided with a cavity (31) and enclosed with part of the display unit (2)

In FIG. 5B, a mold 3 is provided with a cavity 31 and a riser 32. The conjunctive portion of the first port 221 of the lamp 22 and the lead wire 24 is placed in the cavity 31. Then, a fluxed intermediate 23' supplied by a feeder 30 is injected into the cavity 31 via the riser 32, and then the conjunctive portion is solidly covered with the intermediate 23 when the fluxed intermediate 23' is cooled into a state of normal temperature.

After a period of time is passed, the intermediate 23 is integrally molded on the outer surface of the first port 221 of the lamp 22 and the outer surface of the second port 241 of the lead wire 24. That is to say, the conjunctive portion formed by the first port 221 of the lamp 22 and the second port 241 of the lead wire 24 is enclosed by the intermediate 23 and there is no gap or clearance being existed between the intermediate 23 and the conjunctive portion.

FIG. 5C is a cross-sectional view according to FIG. 4. The intermediate 23 is integrally formed on the first port 221 of the lamp 22 and the second port 241 of the lead wire 24. Referring again to FIG. 4, the intermediate 23 covered on the lamp 22 and the lead wire 24 is used as a stopper being placed adjacent to the case 20. Once the lead wire 24 is pulled by an abnormal or abrupt force F, the majority of the force F can be absorbed by intermediate 23, and the lead wire 24 can be fixedly connected to the lamp 22.

Figure 6:
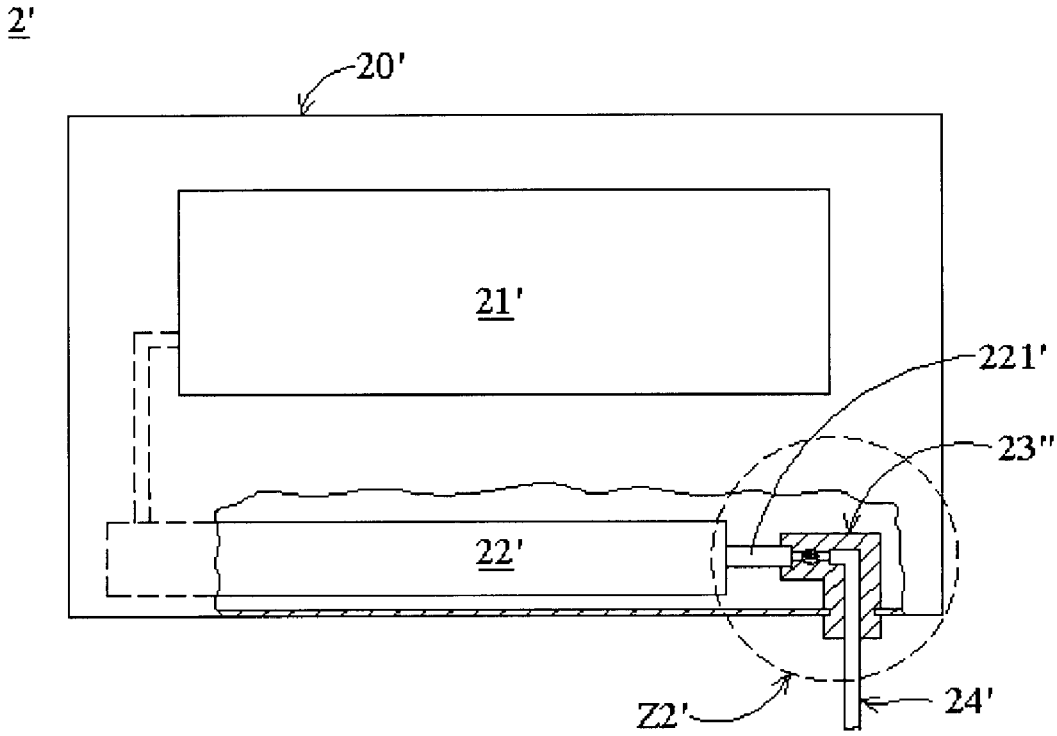
FIG. 6 is a view showing a display unit (2') according to a second embodiment of the present invention.

Referring to FIG. 6, a display unit 2' according to the second embodiment comprises a case 20', a panel 21', a lamp 22' having two first ports 2210'(2210') coated with a plastic material 221'(221'), an intermediate 23'(23') and two lead wires 24'(24'). Each of the two lead wires 24'(24') has a second port 2410'. The lamp 22' is placed next to the panel 21', and the lead wires 24' are electrically connected to the first ports 221'(221') of the lamp 22'. One of the lead wires 24'(24') is applied with high voltage, and the other is grounded.

Figure 7:
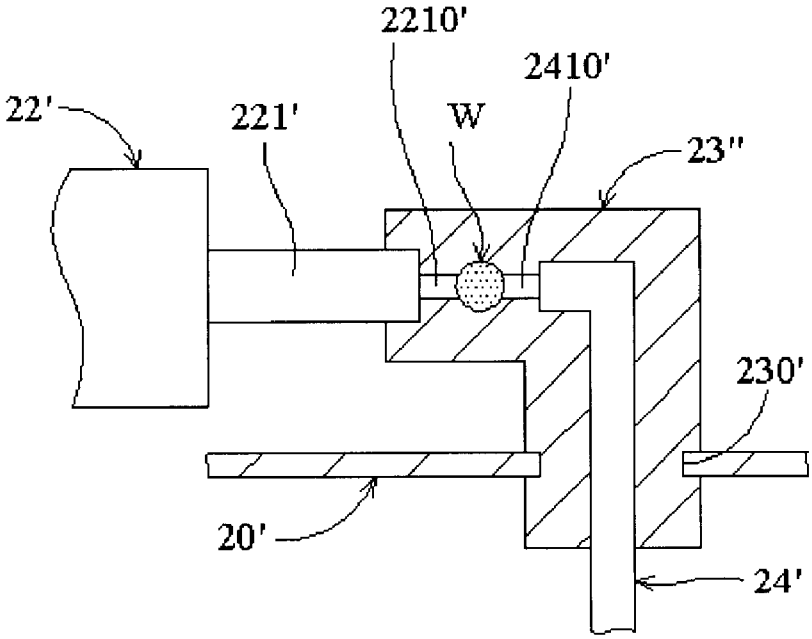
FIG. 7 is an enlarged view according to a region (Z2') of FIG. 6.

In FIG. 7, an enlarged and partially cross-sectional view according to a region Z2' of FIG. 6 is shown.

Each of the second ports 2410'(2410') of the lead wires 24'(24') and each of first ports 2210'(2210') of the lamp 22' are put together by a welding portion W. The two welding portions W(W) between the lead wires 24'(24') and the lamp 22' are constructed as a conjunctive portion, and the intermediate 23" is disposed and integrally formed on the welding portions W(W) and the adjacent related regions by molding process as mentioned above. On the outer surface of the intermediate 23", a positioning portion 230' or a slot is formed. The positioning portion 230' is placed next to and abutted against the case 20' while the lamp 22' connected with the lead wires 24'(24') is disposed on the case 20'.

Thus, the intermediate 23" can directly absorbs the force on the condition that the lead wires 24'(24') are abnormally pulled.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A display unit, comprising:

a case;

a lamp having a first port;

a lead wire having a second port connected to the first port to form a conjunctive portion; and an intermediate disposed on the conjunctive portion and having a positioning portion abutted against the case; wherein the positioning portion is molded around the lead wire and an aperture of the case through which the lead wire extends.

2. The display unit as claimed in claim 1, wherein the intermediate is formed on the conjunctive portion by injection.

3. The display unit as claimed in claim 1, wherein the intermediate is made of polymer such as rubber, thermoplastic or thermosetting material.

4. The display unit as claimed in claim 1, wherein the intermediate is made of UV or Epoxy glue.

5. The display unit as claimed in claim 1, wherein the first port is connected to the second port by welding.

6. A display unit, comprising:

a case;

a panel;

a lamp disposed on the panel, having a first port;

a lead wire electrically connected to the lamp and having a second port connected to the first port to form a conjunctive portion; and an intermediate made of polymer disposed on the conjunctive portion and being placed adjacent to the case;

wherein the conjunctive portion is located at the intersection of the first port of the lamp and the second port of the lead wire and solidly covered with the intermediate such that a gap between the intermediate and the conjunctive portion is non-existent; wherein the intermediate is molded around the lead wire and an aperture of the case through which the lead wire extends.

7. The display unit as claimed in claim 6, wherein the intermediate is formed on the conjunctive portion by injection.

8. The display unit as claimed in claim 6, wherein the intermediate is made of polymer such as rubber, thermoplastic or thermosetting material.

9. The display unit as claimed in claim 6, wherein the intermediate is made of UV or Epoxy glue.

10. A display unit, comprising:

a case;

a panel;

a lamp disposed on the panel, having a first port;

a lead wire having a second port connected to the first port to form a conjunctive portion; and an intermediate integrally formed on the conjunctive portion and abutted against the case while the lamp is disposed on the case; wherein the intermediate is molded around the lead wire and an aperture of the case through which the lead wire extends.

11. The display unit as claimed in claim 10, wherein the intermediate is formed on the conjunctive portion by injection.

12. The display unit as claimed in claim 10, wherein the intermediate is made of polymer such as rubber, thermoplastic or thermosetting material.

13. The display unit as claimed in claim 10, wherein the intermediate is made of UV or Epoxy glue.

* * * * *